US011597217B2

(12) United States Patent
Kamihara et al.

(10) Patent No.: US 11,597,217 B2
(45) Date of Patent: Mar. 7, 2023

(54) SHEET CONVEYOR, SHEET HEATER, LIQUID DISCHARGE APPARATUS, AND PRINTER

(71) Applicants: Kazuaki Kamihara, Tokyo (JP); Masato Ogawa, Kanagawa (JP); Kohki Asada, Tokyo (JP); Hiroshi Sawase, Kanagawa (JP); Yoshihiro Takahashi, Tokyo (JP); Ryusaku Hida, Kanagawa (JP)

(72) Inventors: Kazuaki Kamihara, Tokyo (JP); Masato Ogawa, Kanagawa (JP); Kohki Asada, Tokyo (JP); Hiroshi Sawase, Kanagawa (JP); Yoshihiro Takahashi, Tokyo (JP); Ryusaku Hida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 6 days.

(21) Appl. No.: 17/477,757

(22) Filed: Sep. 17, 2021

(65) Prior Publication Data

US 2022/0111663 A1 Apr. 14, 2022

(30) Foreign Application Priority Data

Oct. 13, 2020 (JP) ..... JP2020-172884

(51) Int. Cl.
*B41J 11/00* (2006.01)
*B41J 11/42* (2006.01)

(52) U.S. Cl.
CPC ..... *B41J 11/00212* (2021.01); *B41J 11/42* (2013.01)

(58) Field of Classification Search
CPC . B41J 11/00212; B41J 11/42; B41J 11/00214; B41J 11/00216; B41J 11/0024
See application file for complete search history.

(56) References Cited

U.S. PATENT DOCUMENTS

| | | | |
|---|---|---|---|
| 2021/0031542 A1 | 2/2021 | Kamihara et al. | |
| 2021/0197584 A1* | 7/2021 | Asada | B41J 29/377 |
| 2021/0221149 A1 | 7/2021 | Nakamura et al. | |

FOREIGN PATENT DOCUMENTS

| | | |
|---|---|---|
| JP | 9-113597 | 5/1997 |
| JP | 2008-003297 | 1/2008 |
| JP | 2013-086457 | 5/2013 |
| JP | 2021-024181 | 2/2021 |

* cited by examiner

*Primary Examiner* — Bradley W Thies
(74) *Attorney, Agent, or Firm* — Duft & Bornsen, PC

(57) ABSTRACT

A sheet conveyor includes an endless conveyance belt configured to rotate to convey a sheet, a belt heater configured to heat the conveyance belt; and circuitry configured to control the conveyance belt to rotate. The conveyance belt has a belt joint joining both ends of a sheet member to form the conveyance belt, and the circuitry controls the conveyance belt to rotate to receive the sheet in an area of the conveyance belt other than the belt joint of the conveyance belt.

12 Claims, 6 Drawing Sheets

SHEET CONVEYOR, SHEET HEATER, LIQUID DISCHARGE APPARATUS, AND PRINTER

CROSS-REFERENCE TO RELATED APPLICATION

This patent application is based on and claims priority pursuant to 35 U.S.C. § 119(a) to Japanese Patent Application No. 2020-172884, filed on Oct. 13, 2020, in the Japan Patent Office, the entire disclosures of which is hereby incorporated by reference herein.

BACKGROUND

Technical Field

Aspects of the present disclosure relate to a sheet conveyor, a sheet heater, a liquid discharge apparatus, and a printer.

Related Art

A printer applies a liquid onto a print target such as a sheet. The printer includes a heater to heat the sheet on which the liquid is applied to accelerate drying of the liquid applied on the sheet.

The printer includes an endless conveyance belt to convey the sheet. An inner surface of the conveyance belt slides while being in contact with a heat transfer plate so that the conveyance belt is heated by the heat transfer plate. Thus, the conveyance belt heated by the heat transfer plate conveys the sheet to heat the sheet.

SUMMARY

In an aspect of this disclosure, a sheet conveyor includes an endless conveyance belt configured to rotate to convey a sheet, a belt heater configured to heat the conveyance belt; and circuitry configured to control the conveyance belt to rotate. The conveyance belt has a belt joint joining both ends of a sheet member to form the conveyance belt, and the circuitry controls the conveyance belt to rotate to receive the sheet in an area of the conveyance belt other than the belt joint of the conveyance belt.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
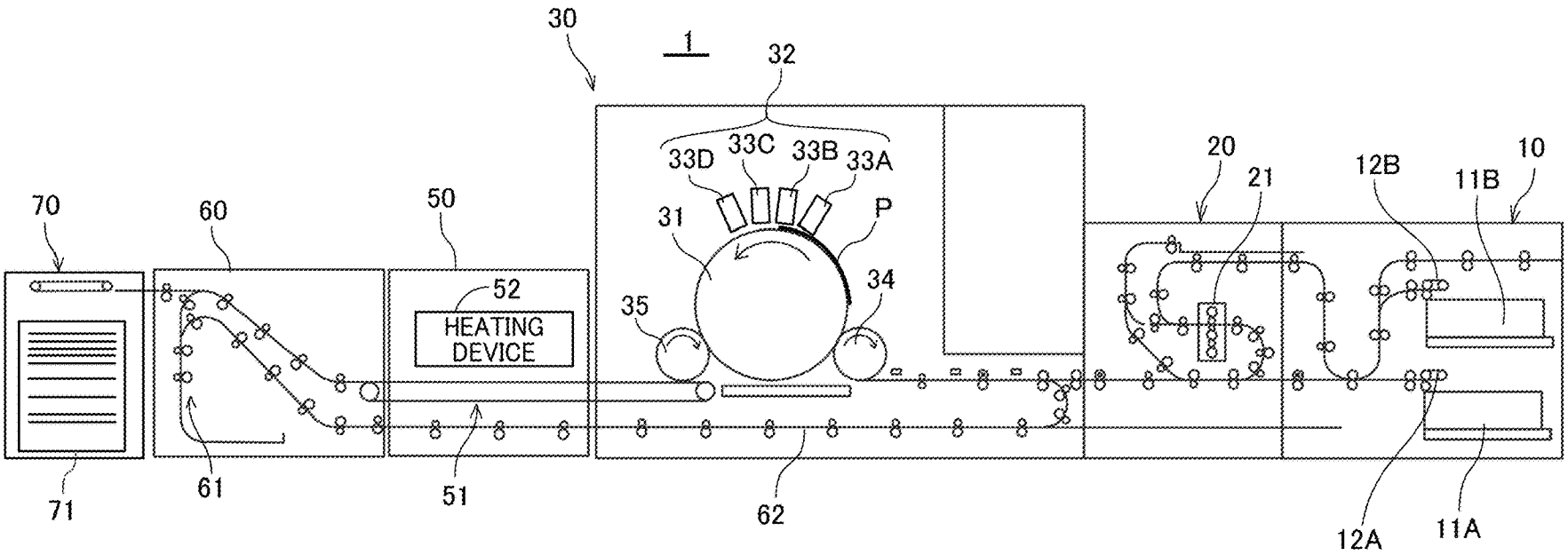
FIG. 1 is a schematic cross-sectional side view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

A printer 1 as a liquid discharge apparatus according to a first embodiment of the present disclosure is described with reference to FIGS. 1 and 2.

FIG. 1 is a schematic cross-sectional side view of the printer 1 according to the first embodiment of the present disclosure.

Figure 2:
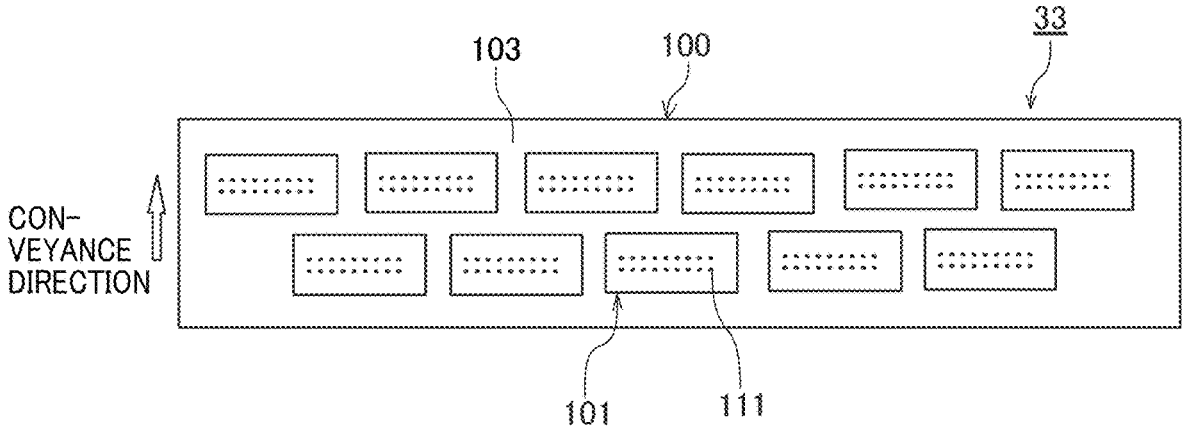
FIG. 2 is a plan view of a discharge unit of the printer.

FIG. 2 is a schematic plan view of a discharge unit 33 of the printer 1.

The printer 1 according to the first embodiment includes a loading unit 10 to load a sheet P into the printer 1, a pretreatment unit 20 as an applier, a printing unit 30, a dryer 50, a reverse mechanism 60, and an ejection unit 70.

In the printer 1, the pretreatment unit 20 applies, as desired, a pretreatment liquid as an application liquid onto the sheet P fed (supplied) from the loading unit 10, the printing unit applies a desired liquid onto the sheet P to perform desired printing.

After the printer 1 dries the liquid adhering to the sheet P by the dryer 50, the printer 1 ejects the sheet P to the ejection unit 70 without printing on a back surface of the sheet P through the reverse mechanism 60. The printer 1 may print on both sides of the sheet P via the reverse mechanism 60 after the printer 1 dries the liquid adhering to the sheet P by the dryer 50, and the printer 1 then ejects the sheet P printed on both sides to the ejection unit 70.

The loading unit 10 includes loading trays 11 (a lower loading tray 11A and an upper loading tray 11B) to accommodate multiple sheets P and feeding units 12 (a feeding unit 12A and a feeding unit 12B) to separate and feed the sheets P one by one from the loading trays 11 and supply the sheets P to the pretreatment unit 20.

The pretreatment unit 20 includes, e.g., a coater 21 as a treatment-liquid application unit that applies a treatment liquid onto the sheet P to coat a print surface of the sheet P with the treatment liquid having an effect of aggregation of ink particles to prevent bleed-through.

The printing unit 30 includes a drum 31 and a liquid discharge device 32. The drum 31 is a bearer (rotating member) that bears the sheet P on a circumferential surface of the drum 31 and rotates. The liquid discharge device 32 discharges liquids toward the sheet P borne on the drum 31.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the dryer 50.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes a plurality of suction holes dispersed on a surface of the drum 31, and a suction unit generates suction airflows directed from desired suction holes of the drum 31 to an interior of the drum 31.

The sheet gripper of the drum 31 grips the leading end of the sheet P forwarded from the transfer cylinder 34 to the drum 31, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) to discharge liquids onto the sheet P as a liquid application device. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). Further, a discharge unit 33 may discharge a special liquid, that is, a liquid of spot color such as white, gold, or silver.

As illustrated in FIG. 2, for example, each of the discharge unit 33 includes a head module 100 including a full line head. The head module 100 includes a plurality of liquid discharge heads 101 arranged in a staggered manner on a base 103. Each of the liquid discharge head 101 includes a plurality of nozzle rows, and a plurality of nozzles 111 is arranged in each of the nozzle rows. Hereinafter, the "liquid discharge head 101" is simply referred to as a "head 101".

The discharge operation of each of the discharge unit 33 of the liquid discharge device 32 is controlled by a drive signal corresponding to print data. When the sheet P borne on the drum 31 passes through a region facing the liquid discharge device 32, the liquids of respective colors are discharged from the discharge units 33 toward the sheet P, and an image corresponding to the print data is formed on the sheet P.

The drum 31 forwards the sheet P onto which a liquid is applied by the liquid discharge device 32 of the printing unit 30 to the transfer cylinder 35. The sheet P is conveyed from the transfer cylinder 35 to a conveyor 51.

The dryer 50 is a drying device including a heating device 52 to heat the sheet P according to the first embodiment of the present disclosure. The heating device 52 of the dryer 50 heats and dries the sheet P, on which the liquid is applied, conveyed by the conveyor 51.

The reverse mechanism 60 includes a reverse part 61 and a duplex conveyor 62. The reverse part 61 reverses the sheet P that has passed through the dryer 50 to dry a first surface of the sheet P onto which the liquid is applied when the printer 1 performs a duplex printing. The duplex conveyor 62 feeds the reversed sheet P back to upstream from the transfer cylinder 34 of the printing unit 30. The reverse part 61 reverses the sheet P by switchback manner. Thus, the reverse mechanism 60 is configured to reverse the sheet P dried by the sheet heater 500 (dryer 50).

The ejection unit 70 includes an ejection tray 71 on which the multiple sheets P is stacked. The multiple sheets P conveyed from the reverse mechanism 60 is sequentially stacked and held on the ejection tray 71.

In the printer 1 according to the first embodiment, an example in which the sheet P is a cut sheet is described. However, the printer 1 according to the first embodiment can also be applied to an apparatus using a continuous medium (web) such as continuous paper or roll paper, an apparatus using a sheet material such as wallpaper, and the like.

A sheet heater 500 according to the first embodiment of the present disclosure is described with reference to FIGS. 3 and 4. The sheet heater 500 includes a sheet conveyor (conveyance device) to convey the sheet P according to the first embodiment of the present disclosure.

Figure 3:
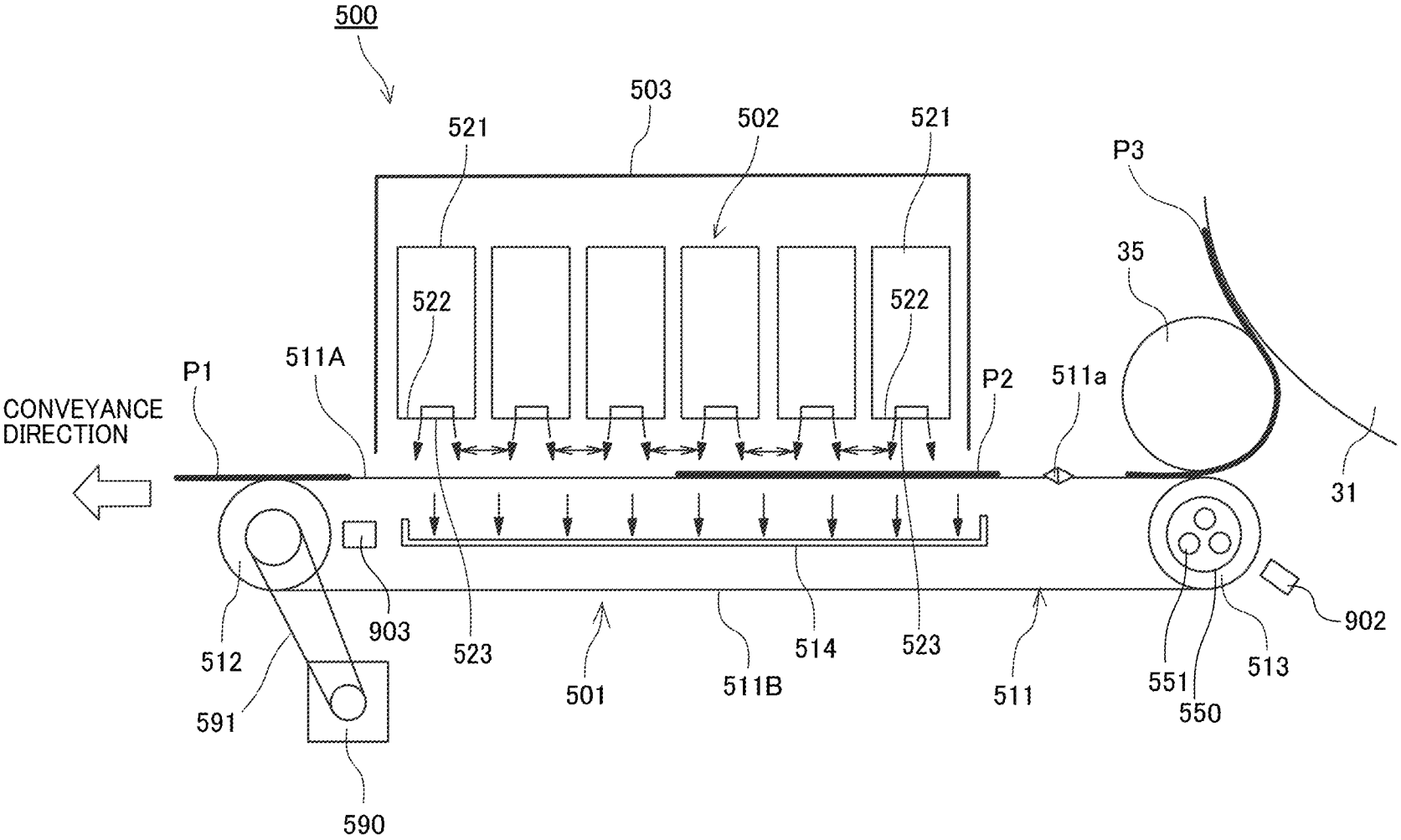
FIG. 3 is a schematic cross-sectional side view of a sheet heater according to the first embodiment of the present disclosure.

FIG. 3 is a schematic cross-sectional side view of the sheet heater 500 according to the first embodiment of the present disclosure.

Figure 4:
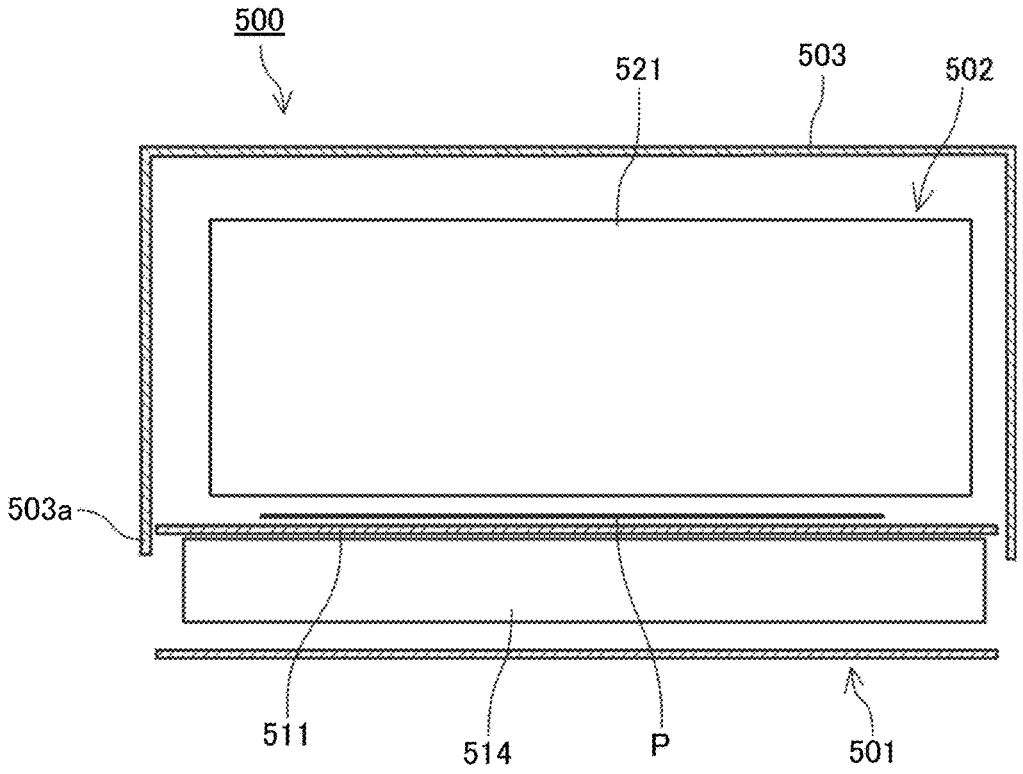
FIG. 4 is a schematic cross-sectional front view of the sheet heater of FIG. 3.

FIG. 4 is a schematic cross-sectional front view of the sheet heater 500 according to the first embodiment of the present disclosure.

The sheet heater 500 to heat the sheet P includes a conveyance mechanism 501 and a first heater 502. The conveyance mechanism 501 serves as a sheet conveyor according to the first embodiment and forms the conveyor 51. The first heater 502 forms the heating device 52. The conveyance mechanism 501 according to the first embodiment includes a mechanism to convey the sheet P from the printing unit 30 to the reverse mechanism 60 across the dryer 50 as illustrated in FIG. 1. The conveyance mechanism 501 includes the conveyor 51 in FIG. 1.

The sheet heater 500 includes not only mechanisms in the dryer 50 (see FIG. 1) but also mechanisms in the printing unit 30 such as the transfer cylinder 35.

FIG. 3 illustrates a state in which three sheets P (sheets P1 to P3) are conveyed.

The conveyance mechanism 501 includes a conveyance belt 511 that bears and conveys the sheet P. The conveyance mechanism 501 serves as a sheet conveyor. The conveyance belt 511 is an endless conveyance member formed by joining both ends of a sheet member having ends and a belt joint 511*a* bonding both ends of the sheet member.

The conveyance belt 511 is stretched between a drive roller 512 as a drive rotator and a driven roller 513 as a driven rotator. Thus, the conveyance belt 511 is wound around the drive roller 512 and the driven roller 513.

The conveyance belt 511 rotates around to convey the sheet P. The drive roller 512 is rotationally driven by, e.g., a drive motor 590 via a timing belt 591.

The conveyance belt 511 is a belt that includes multiple openings from which an air is sucked by a suction chamber 514 arranged inside the conveyance belt 511. The suction chamber 514 serves as a suction device. The conveyance belt 511 may be, for example, a mesh belt, a flat belt having suction holes (openings), or the like.

The suction chamber 514 vacuums (suctions) the sheet P on the conveyance belt 511 through the openings of the conveyance belt 511. A suction force of the suction chamber 514 is generated by a suction device. However, the suction chamber 514 may vacuum the sheet P by a suction blower, a fan, or the like.

Multiple heating elements 551 forms a second heater 550. The multiple heating elements 551 are disposed inside the driven roller 513 of the conveyance mechanism 501. The second heater 550 serves as a device to apply heat to the conveyance belt 511 as a conveyance member. The second heater is also referred to as a "belt heater".

Here, a portion of the conveyance belt 511 that moves in the conveyance direction is referred to as a forward portion 511A. The forward portion 511A of the conveyance belt 511 is a portion, on which the sheet P is placed, to move the sheet P. The surface of the forward portion 511A is also referred to as a "conveyance surface of the sheet P".

The conveyance belt 511 also includes a backward portion 511B opposite to the forward portion 511A. The forward portion 511A faces the first heater 502 and is an upper part of the conveyance belt 511 while the backward portion 511B faces downward and forms a lower part of the conveyance belt 511. The forward portion 511A moves in the conveyance direction indicated by arrow in FIG. 3, and the backward portion 511B moves opposite to the conveyance direction.

The second heater 550 is arranged opposite to the first heater 502 with respect to the conveyance surface of the sheet P. Here, the term "opposite" is not limited to the second heater 550 facing the first heater 502.

The sheet heater 500 includes a belt temperature detector 902 (belt temperature sensor) to detect temperature of the conveyance belt 511 in a vicinity of the driven roller 513. The sheet heater 500 includes a roller temperature detector 903 (roller temperature sensor) to detect temperature of the drive roller 512 in a vicinity of the drive roller 512.

Each of the multiple heating elements 551 of the second heater 550 is, for example, a heater including an infrared heater (IR lamp) or the like. Each of the multiple heating elements 551 of the second heater 550 heats an interior of the driven roller 513 to heat a conveyance member such as the conveyance belt 511 in contact with the driven roller 513.

The infrared heater used as each of the multiple heating elements 551 is, for example, a carbon heater, a tungsten heater, a halogen heater, a ceramic heater, and the like, but is not limited to the heaters as described above and may be any other types of heaters. Further, the multiple heating elements 551 disposed inside the driven roller 513 can efficiently transfer heat of the multiple heating elements 551 to a surface of the driven roller 513 in an outer peripheral direction without leaking of the heat.

The first heater 502 includes multiple ultraviolet irradiators 521 in a housing 503. The multiple ultraviolet irradiators 521 arranged in a housing 503 along the conveyance direction of the sheet P. The multiple ultraviolet irradiators 521 irradiate the sheet P conveyed by the conveyance mechanism 501 with ultraviolet rays to heat the sheet P.

As illustrated in FIG. 3, the housing 503 is arranged to have a gap with the conveyance belt 511 in a vertical direction, and the gap is formed along the conveyance direction of the sheet P. As illustrated in FIG. 4, the housing 503 includes an extension portion 503*a* extended lower than the conveyance belt 511 in a vertical (height) perpendicular to the conveyance direction of the sheet P.

The ultraviolet irradiator 521 includes granular ultraviolet light emitting diode elements 523 (UV-LED elements) arranged in a grid pattern on an irradiation surface 522 of the ultraviolet irradiator 521. Since the UV-LED elements 523 emit light at an identical illuminance, the ultraviolet irradiator 521 uniformly emits light along the irradiation surface 522 as a whole. As a wavelength of the ultraviolet light (UV light), a wavelength having a peak wavelength of 395 nm and a wavelength distribution having a full width at half maximum of about 15 nm is used.

Thus, the ultraviolet irradiator 521 can obtain an effect of selectively heating only an image part (a part onto which the liquid is applied) and not excessively raising a temperature of a blank part (a part onto which the liquid is not applied).

In the sheet heater 500 according to the first embodiment, the sheet P fed onto the conveyance belt 511 from upstream of the conveyance belt 511 is attracted to the conveyance belt 511 by suction force generated by the suction chamber 514.

The multiple heating elements 551 inside the driven roller 513 heats the driven roller 513 so that the multiple heating elements 551 heats a portion of the conveyance belt 511 that passes from the driven roller 513 to the housing 503.

Thus, the sheet P attracted to and contacted with the conveyance belt 511 receives heat transferred from the conveyance belt 511, and the temperature of the sheet P increases. That is, the conveyance belt 511 serves as a heat transfer device to transfer the heat generated by the multiple heating elements 551 of the second heater 550 to the sheet P.

The multiple ultraviolet irradiators 521 of the first heater 502 irradiate the sheet P with ultraviolet rays so that the ink as a liquid applied to the sheet P absorbs the ultraviolet rays. The pigment in the ink generates heat that evaporates solvent and moisture in the ink and dries the ink.

In the above-described way, the sheet heater 500 can efficiently heat the ink on the sheet P since the pigment in the liquid (ink) generates heat while the temperature of the sheet P rises by the heat transferred from the conveyance belt 511 to the sheet P. The conveyance belt 511 serves as a conveyance member to convey the sheet P.

Thus, the sheet heater 500 can prevent or reduce the heat of the image portion generated by the ultraviolet irradiation to be transferred to the sheet P or the conveyance belt 511. Therefore, the sheet heater 500 can effectively apply heat of the image portion to an evaporation phenomenon of the solvent and moisture in the ink.

Figure 5:
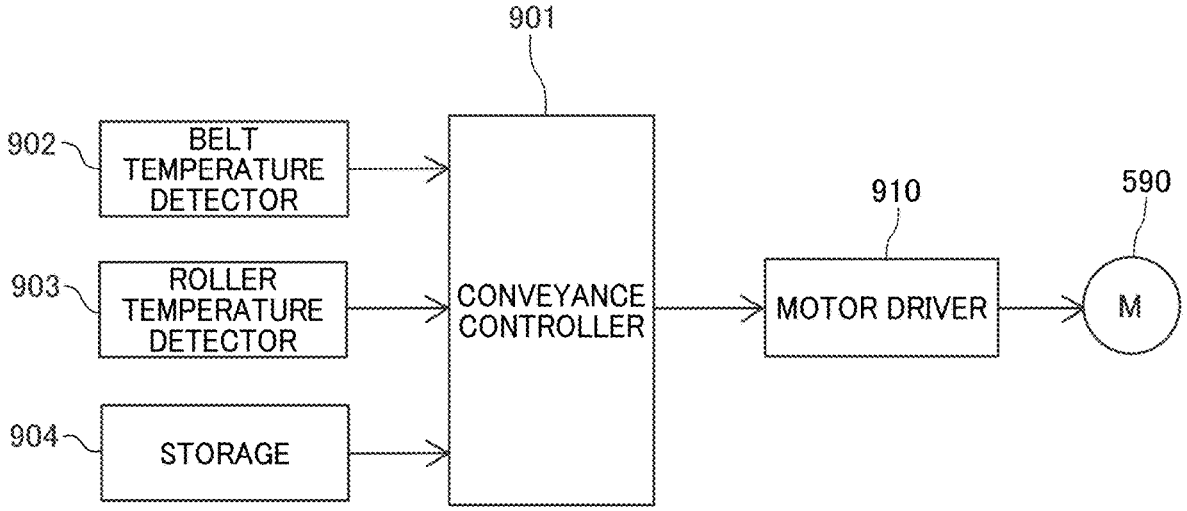
FIG. 5 is a block diagram of a portion related to a control of the circumferential movement of the conveyance belt.

Next, a portion related to a control of the circumferential movement of the conveyance belt 511 is described below with reference to the block diagram of FIG. 5.

The sheet heater 500 includes a conveyance controller 901 (circuitry) that controls a rotational drive of the drive motor 590 to rotate the drive roller 512 via the motor driver 910.

The conveyance controller 901 inputs temperature (belt temperature) of the conveyance belt 511 detected by the belt temperature detector 902. The conveyance controller 901 inputs the temperature (roller temperature) of the drive roller 512 detected by the roller temperature detector 903.

The sheet heater 500 includes a storage 904 to store information such as a thermal expansion coefficient of the conveyance belt 511, a conveyance speed of the sheet P by the transfer cylinder 35, and a conveyance speed of the sheet P in the reverse mechanism 60.

The conveyance controller 901 drives and controls the drive motor 590 to control the circumferential movement of the conveyance belt 511 according to the belt temperature detected by the belt temperature detector 902, the roller temperature detected by the roller temperature detector 903, and information stored in the storage 904. At this time, the conveyance controller 901 controls the circumferential movement of the conveyance belt 511 so that the sheet P does not come into contact with the belt joint 511*a* of the conveyance belt 511.

Next, an example of control of the circumferential movement of the conveyance belt 511 in the first embodiment is described with reference to FIGS. 6 and 7.

Figure 6:
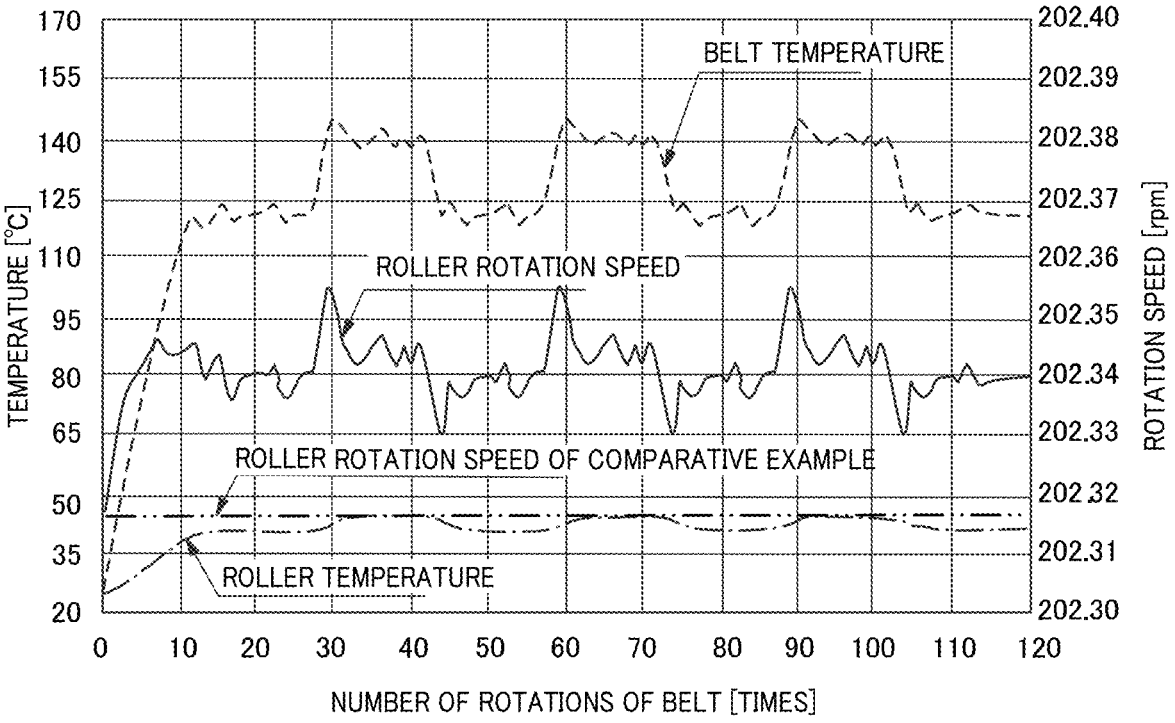
FIG. 6 is a graph illustrating an example of a relation among a number of rotation of the conveyance belt, temperature of the conveyance belt, and a rotation speed of the drive roller to illustrate the control of the circumferential movement of conveyance belt.

FIG. 6 is a graph illustrating an example of a relation among a number of rotation (revolution) of the conveyance belt 511, the temperature of the conveyance belt 511, and a rotation speed of the drive roller 512.

Figure 7:
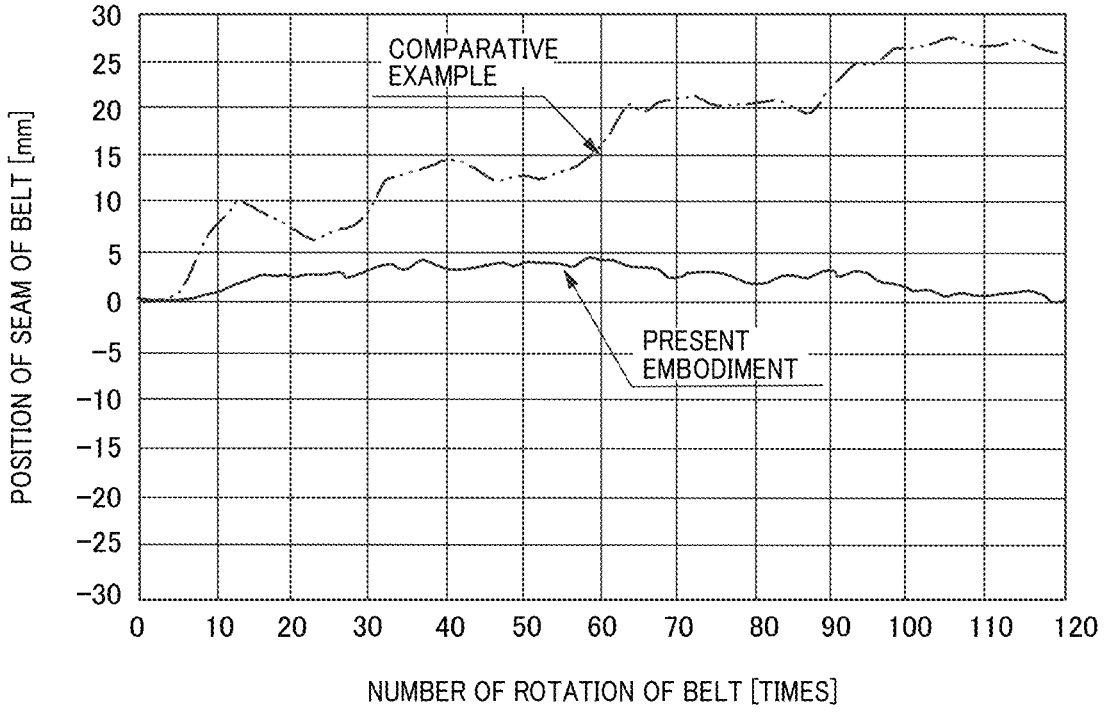
FIG. 7 is a graph illustrating an example of a relation between the number of rotation of the conveyance belt and a change in a position of the belt joint.

FIG. 7 is a graph illustrating an example of a relation between the number of rotation of the conveyance belt 511 and a change in a position of the belt joint.

The sheet P onto which the liquid has been applied is delivered from the drum 31 to the transfer cylinder 35. The sheet gripper (gripping claw) holding the leading end of the sheet P at a downstream end the transfer cylinder 35 is opened, and the sheet P lands on the conveyance belt 511.

Here, a belt including suction holes is used as the conveyance belt 511, for example. Each of the suction hole of the belt has a diameter of 3 mm, and the suction holes are arranged at 10 mm intervals in the belt. A belt having ends (upstream end and downstream end) in the conveyance direction is used as the conveyance belt 511. The ends of the belt are joined together inside the printer 1 to form the conveyance belt 511. Therefore, one belt joint 511*a* exists when the conveyance belt 511 rotates one round (makes one revolution).

A front region and a rear region of the belt joint 511*a* of the conveyance belt 511 do not include the suction holes. Further, the conveyance belt 511 has a step between the belt joint 511*a* and areas other than the belt joint 511*a* of the conveyance belt 511 since a thickness of the belt joint 511*a* is thicker than the areas other than the belt joint 511*a* of the conveyance belt 511 for reinforcement of the belt joint 511*a*. When the sheet P separated from the transfer cylinder 35 lands on the front region and the rear region of the belt joint 511*a* of the conveyance belt 511, the conveyance belt 511 may not properly suction the sheet P onto the conveyance belt 511 that may cause a paper jam.

Thus, the conveyance controller 901 of the sheet heater 500 according to the first embodiment controls the belt joint 511*a* of the conveyance belt 511 to be positioned in an area between a preceding sheet P and a following sheet P to prevent the sheet P from landing on the belt joint 511*a* of the conveyance belt 511 even when a printing process is continuously performed to print an image on the multiple sheets P.

Thus, the sheet heater 500 conveys multiple sheets P, and conveyance controller 901 (circuitry) controls the rotation speed of the drive roller 512 to position the belt joint 511*a* of the conveyance belt 511 in an area between a preceding sheet P and a following sheet P.

To prevent the sheet P from landing on the belt joint 511*a*, the conveyance controller 901 aligns (adjusts) drive start timings of the conveyance belt 511 and the transfer cylinder 35 upstream of the conveyance belt 511. Then, the conveyance controller 901 sets a cycle TD of the belt joint 511*a* of the conveyance belt 511 to an integer multiple of a conveyance cycle TP of the sheet P.

The cycle TD of the belt joint 511*a* is a time interval at which the belt joint 511*a* passes through a specific position during rotation of the conveyance belt 511. The conveyance cycle TP of the sheet P is a time interval from landing of the preceding sheet P to landing of the following sheet P.

For example, the conveyance cycle TP of the sheet P is 791 msec when a conveyance interval of the sheet P on the transfer cylinder 35 is 1005.3 mm and a linear velocity is 1270.0 mm/s. Further, the cycle TD of the belt joint 511*a* of the conveyance belt 511 is set to 3958 msec which is about five times the conveyance cycle TP of the sheet P.

The circumferential length LDi of the conveyance belt 511 at 25° C. is set to 5031.5 mm (LDi=5031.5 mm) by including (considering) an elongation of the conveyance belt 511 in a tensioned state. Thus, the conveyance controller 901 can maintain the cycle TD=3958 msec of the belt joint 511*a* when the conveyance belt 511 is driven at a linear velocity VD=1271.3 mm/s.

Here, a roller having a diameter of 120 mm and a circumferential length LRi of 377.0 mm (LRi=377.0 mm) at 25° C. is used as the drive roller 512. Thus, the conveyance controller 901 can initially maintain the cycle TD=3958 msec of the belt joint 511*a* when the drive roller 512 is driven at a rotation speed RD=202.3 rpm. Thus, the conveyance controller 901 can control the sheet P to be continuously landed on the conveyance belt 511 while avoiding the sheet P to be landed on the belt joint 511*a* of the conveyance belt 511.

However, the sheet heater 500 in the first embodiment includes the second heater 550 to heat the conveyance belt 511 to improve a heating energy efficiency to heat the sheet P. When the conveyance belt 511 is heated, the conveyance belt 511 and the drive roller 512 also thermally expand. Thus, the cycle TD of the belt joint 511*a* deviates from an initial setting.

Therefore, the sheet heater 500 according to the first embodiment detects temperature (belt temperature) TB of the conveyance belt 511 by the belt temperature detector 902 each time the conveyance belt 511 makes one revolution (rotates one round). The roller temperature detector 903 detects temperature of roller (roller temperature) TR of the drive roller 512.

At the time of detecting the roller temperature TR, the belt temperature TB of the conveyance belt 511 changes as indicated by a broken line in FIG. 6, and the roller temperature TD of the drive roller 512 changes as indicated by a dash-single-dot line as illustrated in FIG. 6 as a number of rotations (revolutions) of the conveyance belt 511 increases, for example.

Therefore, the conveyance controller 901 controls a rotation speed of the drive roller 512 (roller rotation speed) as indicated by a solid line in FIG. 6 according to the detected belt temperature TB and the roller temperature TR.

Sheet-like members made of glass fiber impregnated with fluorine resin are connected (joined) to be used as the conveyance belt 511 in the first embodiment. In the above case, a linear expansion coefficient of a thermal expansion of the conveyance belt 511 is $5\times10^{-6}$. When the circumferential length at 25° C. is LDi, the circumferential length LD of the conveyance belt 511 in consideration of thermal expansion can be calculated by a following equation.

$$LD=LDi\times(1+5\times10^{-6}\times(TB-25^\circ\ \mathrm{C.}))$$

A roller member made of aluminum is used as the drive roller 512. In the above case, a linear expansion coefficient of a thermal expansion of the drive roller 512 is 23×10', and the circumferential length LR of the drive roller 512 in consideration of the thermal expansion can be calculated by the following equation when the circumferential length at 25° C. is denoted as "LRi".

$$LR=LRi\times(1+23\times10^{-6}\times(TR-25^\circ\text{ C.}))$$

Thus, the conveyance controller 901 rotationally drives the drive roller 512 via the drive motor 590 so that a rotation speed of the drive motor 590 becomes the rotation speed RD calculated by a following equation.

$$RD[\text{rpm}]=(LD[\text{mm}]\div TD[\text{msec}]\times1000)\div LR\times60$$

Thus, the sheet heater 500 can reduce an amount of deviation of the belt joint 511*a* of the conveyance belt 511 from an initial position (0) within 5 mm even if the number of rotation (revolution) of the conveyance belt 511 increases in the first embodiment (present embodiment) as illustrated by a solid line in FIG. 7.

Thus, the conveyance controller 901 of the sheet heater 500 can continuously controls landing positions of the sheet P in an area of the conveyance belt 511 other than the belt joint 511*a* so that the sheet P does not contact the belt joint 511*a* of the conveyance belt 511 even when the printer 1 continuously performs a printing process.

Thus, the conveyance controller 901 (circuitry) controls to rotate the conveyance belt 511 (endless belt) to land the sheet P in an area of the conveyance belt 511 (endless belt) other than the belt joint 511*a* of the conveyance belt 511.

On the other hand, a comparative example as indicated by a two-dot chain line in FIG. 6 controls a rotation speed of the drive roller 512 to be constant. Thus, as indicated by the two-dot chain line in FIG. 7, an amount of deviation of the belt joint 511*a* of the conveyance belt 511 from the initial position (0) increases as the number of rotation (revolution) of the conveyance belt 511 increases.

As described above, the cycle TD of the belt joint 511*a* is gradually shifted when the conveyance belt 511 is heated in the comparative example. Finally, the landing position of the sheet P is caught by the belt joint 511*a* of the conveyance belt 511, and a paper jam occurs.

Next, an example of a control range of the rotation speed RD of the drive roller 512 is described below.

In the following, "Vp" denotes a conveyance linear velocity for conveyance of the sheet P in the printing unit 30 that passes the sheet P to the conveyance belt 511. "Vd" denotes a linear velocity of the conveyance belt 511. "Ve" denotes a conveyance linear velocity of the sheet P in the reverse mechanism 60 that receives the sheet P from the conveyance belt 511.

Here, the conveyance linear velocity Vp and the conveyance linear velocity Ve are fixed values. The linear velocity Vd of the conveyance belt 511 is varied between the minimum linear velocity Vdmin and the maximum linear velocity Vdmax so that the cycle TD of the belt joint 511*a* becomes constant.

Thus, the linear velocity Vp of the printing unit 30 and the linear velocity Ve of the reverse mechanism 60 are fixed value, and the conveyance controller 901 (circuitry) controls the rotation speed of the drive roller 512 to vary the linear velocity Vd of the conveyance belt 511 to control the cycle TD of the belt joint 511*a* of the conveyance belt 511 to be constant.

Thus, the conveyance controller 901 (circuitry) controls a rotation speed of the drive roller 512 according to a detection result of at least one of the belt temperature detector 902 and the roller temperature detector 903 to control the cycle TD of the belt joint 511*a* of the conveyance belt 511 to be constant.

At this time, the conveyance controller 901 controls the rotation speed of the drive roller 512 to satisfy a relation of Vp<Vdmin<Vdmax<Ve. The conveyance controller 901 controls the linear speed Vd of the conveyance belt 511 to be equal to or larger than a conveyance linear speed Vp of the printing unit 30 that conveys the sheet P to the conveyance belt 511. The conveyance controller 901 controls the linear speed Vd of the conveyance belt 511 to be equal to or smaller than the conveyance linear speed Ve of the sheet P in the reverse mechanism 60 that receives the sheet P from the conveyance belt 511.

In the above way, the conveyance controller 901 controls the linear velocity increases toward a downstream end of the printer 1 (increases from the printing unit 30 toward the reverse mechanism 60) in the conveying direction of the sheet P. Thus, the sheet P does not slacken when the sheet P is fed from the printing unit 30 to the dryer 45 and from the dryer 50 to the reverse mechanism 60 and the ejection unit 70.

Accordingly, the sheet heater 500 according to the second embodiment can reduce occurrence of the paper jam of the sheet P and stably convey the sheet P.

Next, the sheet heater 500 according to a second embodiment of the present disclosure is described with reference to FIG. 8.

Figure 8:
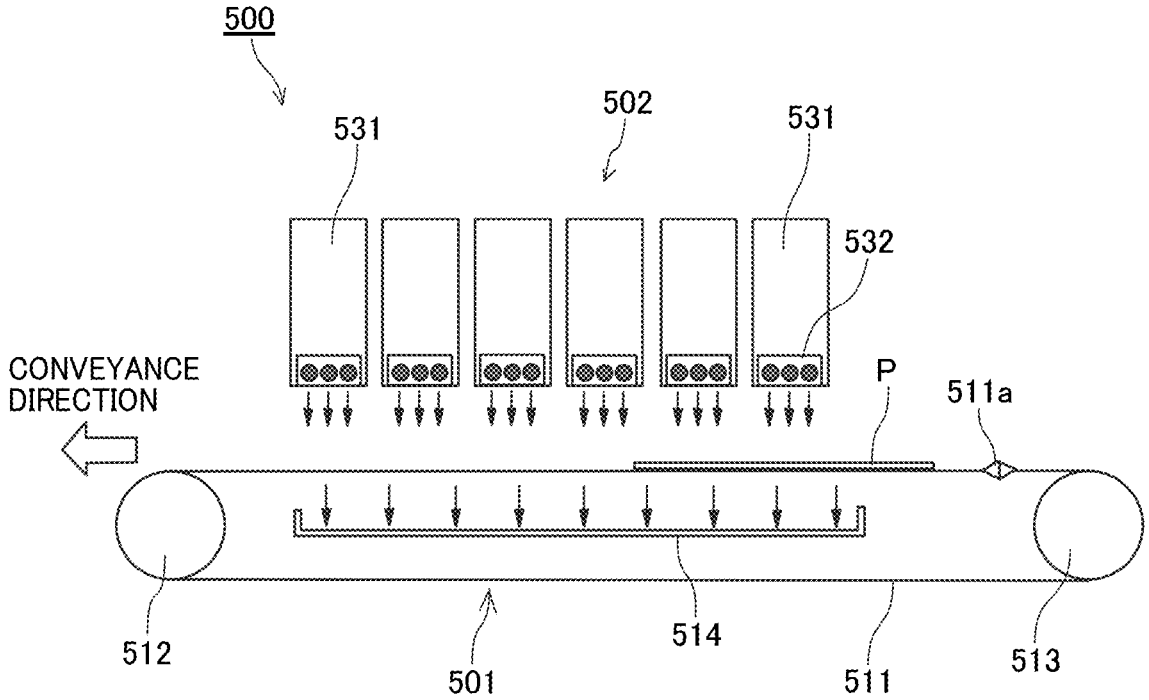
FIG. 8 is a schematic cross-sectional side view of a sheet heater according to a second embodiment of the present disclosure.

FIG. 8 is a schematic cross-sectional side view of a sheet heater 500 according to the second embodiment of the present disclosure.

The first heater 502 of the sheet heater 500 according to the second embodiment includes an infrared irradiators 531. Each of the infrared irradiator 531 includes a near infrared heater 532 (NIR heater). The NIR heater 532 emits infrared rays having a peak wavelength in a near infrared region (about 0.78 μm to 1.5 μm).

Moisture contained in the sheet P has large absorption bands in a vicinity of 1.5 μm, 1.9 μm, and 2.5 μm, and a total absorption gradually increases toward lower wavelengths. Therefore, the NIR heater 532 having a peak wavelength in a wavelength region of less than 1.5 μm can obtain the same effect as the ultraviolet irradiator 521.

Further, the NIR heater 532 can be used to heat the sheet P from a conveyance member side (conveyance belt 511 side). Thus, the sheet heater 500 according to the second embodiment can reduce an output of the NIR heater 532 or reduce a number of the NIR heaters 532.

The sheet heater 500 in the second embodiment, unlike the first embodiment, does not include the second heater 550 to heat the conveyance belt 511 in the driven roller 513. However, the sheet heater 500 in the second embodiment can also heat the conveyance belt 511 by the infrared irradiators 531. Thus, the first heater 502 is a device that applies heat to the conveyance member (conveyance belt 511).

Therefore, the conveyance controller 901 controls a circumferential movement of the conveyance belt 511 in the same manner as in the first embodiment. Thus, the conveyance controller 901 can controls the sheet P to be continuously landed on the conveyance belt 511 on a region other than the belt joint 511*a* so that the sheet P does not contact with the belt joint 511*a* of the conveyance belt 511 even when the printer 1 continuously performs the printing process. However, the sheet heater 500 according to the second embodiment as illustrated in FIG. 8 may include the second heater 550 to heat the conveyance belt 511 as in the sheet heater 500 in the first embodiment as illustrated in FIG. 3.

Next, the sheet heater 500 according to a third embodiment of the present disclosure is described with reference to FIG. 9.

Figure 9:
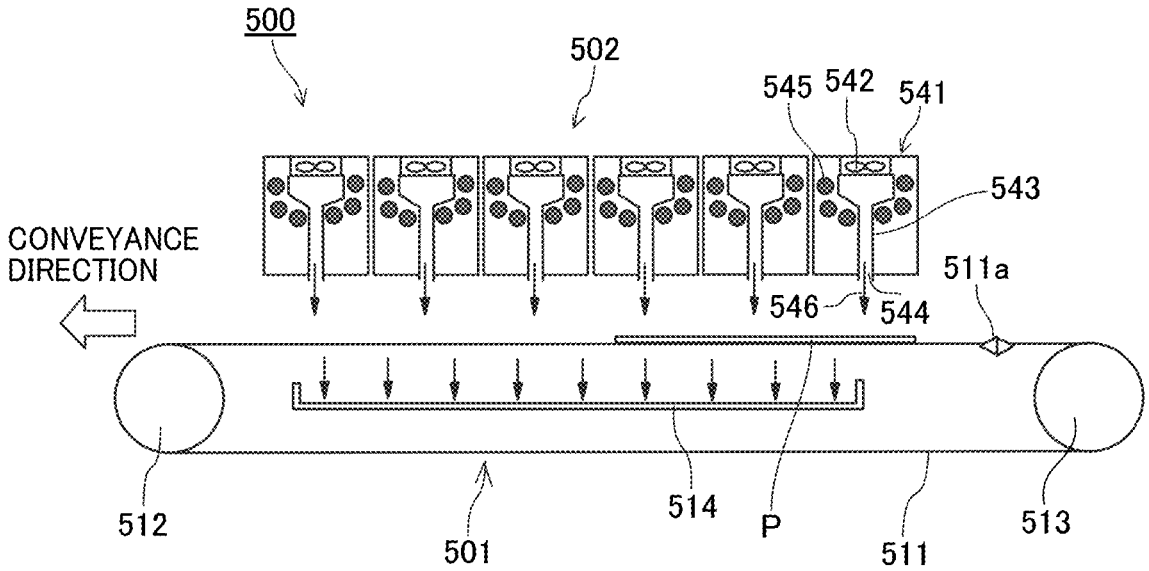
FIG. 9 is a schematic cross-sectional side view of a sheet heater according to a third embodiment of the present disclosure.

FIG. 9 is a schematic cross-sectional side view of the sheet heater 500 according to the third embodiment of the present disclosure.

The first heater 502 of the sheet heater 500 includes air blowers 541. The air blower 541 includes a fan 542, a channel 543, a nozzle 544, and an infrared heater 545. The fan 542 sucks air outside the sheet heater 500. The nozzle 544 is also referred to as a "blowout port".

The air blower 541 heats the air taken inside the channel 543 by the fan 542 with the infrared heater 545 and blows warm air 546 from the nozzle 544 toward the sheet P through the channel 543. Thus, the air blower 541 reduce a vapor density in a vicinity of the sheet P to promote evaporation of the moisture in the ink while raising the temperature of the solvent and moisture in the ink applied onto the sheet P.

The sheet heater 500 in the third embodiment, unlike the first embodiment, does not include the second heater 550 to heat the conveyance belt 511 in the driven roller 513. However, the sheet heater 500 in the third embodiment can also heat the conveyance belt 511 by the air blowers 541. Thus, the first heater 502 is a device that applies heat to the conveyance member (conveyance belt 511).

Therefore, the conveyance controller 901 controls a circumferential movement of the conveyance belt 511 in the same manner as in the first embodiment. Thus, the conveyance controller 901 can controls the sheet P to be continuously landed on the conveyance belt 511 on a region other than the belt joint 511*a* so that the sheet P does not contact with the belt joint 511*a* of the conveyance belt 511 even when the printer 1 continuously performs the printing process. However, the sheet heater 500 according to the second embodiment as illustrated in FIG. 8 may include the second heater 550 to heat the conveyance belt 511 as in the sheet heater 500 in the first embodiment as illustrated in FIG. 3.

In the present embodiments, a "liquid" discharged from the head is not particularly limited as long as the liquid has a viscosity and surface tension of degrees dischargeable from the head.

However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Further, the water-based pigment ink is not limited to the above-mentioned embodiments and may contain an ultraviolet polymerization initiator and an ultraviolet polymerizable compound.

In this case, the water-based pigment ink preferably contains the ultraviolet polymerization initiator and the ultraviolet polymerizable compound, content of which does not cause or hardly cause curing due to a polymerization reaction even when the first heater irradiates the water-based pigment ink with light (ultraviolet rays).

Specifically, the content of the ultraviolet polymerization initiator in an ink composition is less than 0.1% by mass, or the content of the ultraviolet polymerizable compound in the ink composition is less than 5% by mass.

Such a configuration of the water-based pigment ink can reduce a running cost and obtain a printed matter having good safety.

The ultraviolet polymerizable compound may be a monomer or an oligomer.

Examples of the ultraviolet polymerizable compound include methacrylic acid.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials to which liquid can adhere, but also apparatuses to discharge a liquid toward gas or into a liquid.

The "liquid discharge apparatus" may include units to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can adhere" represents a material on which liquid is at least temporarily adhered, a material on which liquid is adhered and fixed, or a material into which liquid is adhered to permeate.

Examples of the "material on which liquid can adhere" include recording media, such as paper sheet, recording paper, recording sheet of paper, film, and cloth, electronic component, such as electronic substrate and piezoelectric element, and media, such as powder layer, organ model, and testing cell.

The "material on which liquid can adhere" includes any material on which liquid is adhered, unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere.

However, the liquid discharge apparatus is not limited to such an apparatus.

For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Each of the functions of the described embodiments such as the conveyance controller 901 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet conveyor comprising:

an endless conveyance belt configured to rotate to convey a sheet;

a belt heater configured to heat the conveyance belt; and circuitry configured to control the conveyance belt to rotate, wherein the conveyance belt has a belt joint joining both ends of a sheet member to form the conveyance belt, and the circuitry controls the conveyance belt to rotate to receive the sheet in an area of the conveyance belt other than the belt joint of the conveyance belt.

2. The sheet conveyor according to claim 1, further comprising:

a temperature detector configured to detect temperature, wherein the conveyance belt is wound around a drive roller and a driven roller, the temperature detector detects temperature of at least one of the conveyance belt and the drive roller, the circuitry controls a rotation speed of the drive roller according to a detection result of the temperature detector to control a cycle of the belt joint to be constant, and the cycle of the belt joint is a time interval at which the belt joint passes through a specific position during rotation of the conveyance belt.

3. The sheet conveyor according to claim 2, wherein the sheet conveyor conveys multiple sheets, and the circuitry controls the rotation speed of the drive roller to position the belt joint of the conveyance belt in an area between a preceding sheet and a following sheet.

4. The sheet conveyor according to claim 2, wherein the belt heater includes multiple heating elements inside the driven roller of the conveyance belt.

5. A sheet heater comprising:

the sheet conveyor according to claim 2; and an ultraviolet irradiator configured to irradiate the sheet conveyed by the conveyance belt with ultraviolet rays to heat the sheet.

6. A liquid discharge apparatus comprising:

a printing unit configured to apply a liquid on a sheet; and the sheet heater according to claim 5 configured to heat and dry the liquid applied on the sheet by the printing unit, wherein a linear velocity of the conveyance belt of the sheet heater is equal to or larger than a linear velocity of the printing unit for conveying the sheet to the sheet heater.

7. The liquid discharge apparatus according to claim 6, further comprising:

a reverse mechanism configured to reverse the sheet dried by the sheet heater, wherein the linear velocity of the conveyance belt of the sheet heater is equal to or smaller than a linear velocity of the reverse mechanism for conveying the sheet.

8. The liquid discharge apparatus according to claim 7, wherein the linear velocity of the printing unit and the linear velocity of the reverse mechanism are fixed value, and the circuitry controls the rotation speed of the drive roller to vary the linear velocity of the conveyance belt to control the cycle of the belt joint to be constant.

9. The liquid discharge apparatus according to claim 6, wherein the printing unit includes a head configured to discharge a liquid onto a sheet; and the sheet heater heats and dries the liquid discharged onto the sheet by the head.

10. A printer comprising the liquid discharge apparatus according to claim 9 configured to discharge the liquid onto the sheet to form an image on the sheet.

11. A sheet heater comprising:

the sheet conveyor according to claim 2; and an infrared irradiator configured to irradiate the sheet conveyed by the conveyance belt with infrared rays to heat the sheet.

12. The sheet heater according to claim 11, wherein the infrared irradiator is configured to heat the conveyance belt.

* * * * *